US008631937B2

(12) United States Patent
Lecoutre

(10) Patent No.: US 8,631,937 B2
(45) Date of Patent: Jan. 21, 2014

(54) PACKAGING ASSEMBLY

(75) Inventor: Jean-Paul Lecoutre, Conde sur Iton (FR)

(73) Assignee: Aptar France SAS, Le Neubourg (FR)

( * ) Notice: Subject to any disclaimer, the term of this patent is extended or adjusted under 35 U.S.C. 154(b) by 0 days.

(21) Appl. No.: 13/201,541

(22) PCT Filed: Feb. 11, 2010

(86) PCT No.: PCT/FR2010/050231

§ 371 (c)(1),
(2), (4) Date: Aug. 15, 2011

(87) PCT Pub. No.: WO2010/092305

PCT Pub. Date: Aug. 19, 2010

(65) Prior Publication Data

US 2011/0297574 A1 Dec. 8, 2011

(30) Foreign Application Priority Data

Feb. 16, 2009 (FR) ..... 09 50961

(51) Int. Cl.
*B65D 73/00* (2006.01)

(52) U.S. Cl.
USPC ..... 206/482; 206/472; 206/480; 248/316.7

(58) Field of Classification Search
USPC ..... 206/461, 462, 467, 468, 471, 477, 480, 206/481, 482, 486, 488, 489, 581, 472, 206/473; 281/30; 248/309.1, 311.2, 313, 248/316.1, 316.7
See application file for complete search history.

(56) References Cited

U.S. PATENT DOCUMENTS 2,469,451 A * 5/1949 Burrus ..... 248/316.7
2,541,828 A * 2/1951 Peck ..... 206/480
3,154,281 A * 10/1964 Frank ..... 248/201
3,275,274 A * 9/1966 Hutcheon ..... 248/309.1
3,286,835 A * 11/1966 Crane, Jr. ..... 206/489

(Continued)

FOREIGN PATENT DOCUMENTS

DE 88 00 244 U1 5/1988
FR 2 732 875 A1 10/1996

(Continued)

OTHER PUBLICATIONS

International Preliminary Report on Patentability for PCT/FR2010/050231, dated Aug. 16, 2011, English Translation.

*Primary Examiner* — Luan K Bui
(74) *Attorney, Agent, or Firm* — Sughrue Mion, PLLC

(57) ABSTRACT

A packaging assembly comprising:
a card comprising at least one panel;
a fluid dispenser comprising a fluid reservoir and a fluid dispenser member that is mounted on the reservoir; and
a connection element fitted on the panel and including fastener means, the dispenser being engaged in the fastener means for being held in removable manner on the card;
wherein the panel includes a window, the connection element being fitted in the window, the connection element includes a base, advantageously a flat base, of dimension that is greater than the dimension of the window, the fastener means projecting from the base, the base being disposed on one side of the panel with the fastener means passing through the window in such a manner as to project from the other side of the panel, the fastener means being inserted through the window and presenting a dimension that is greater than the dimension of the window, thereby holding the connection element in the window.

14 Claims, 3 Drawing Sheets

(56) References Cited

U.S. PATENT DOCUMENTS

Figure 1:
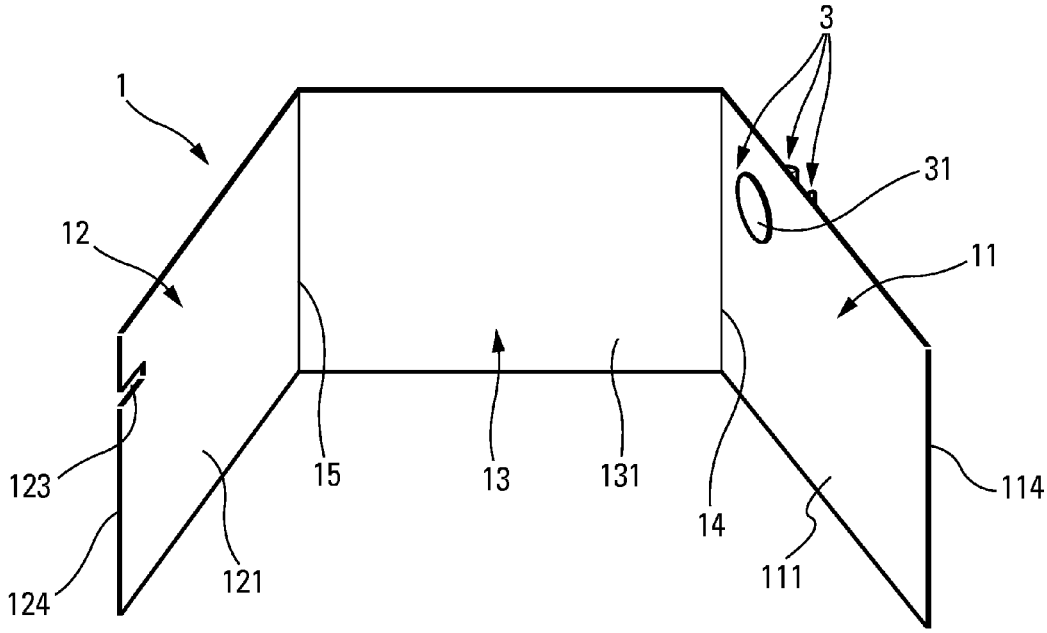

| | | | | | |
|---|---|---|---|---|---|
| 3,423,059 | A | * | 1/1969 | Kahn | 248/316.7 |
| 3,927,765 | A | * | 12/1975 | Beal | 206/481 |
| 4,119,285 | A | * | 10/1978 | Bisping et al. | 248/222.12 |
| 4,306,737 | A | * | 12/1981 | Errichiello | 206/472 |
| 4,328,894 | A | * | 5/1982 | Edell | 206/461 |
| 4,925,029 | A | | 5/1990 | Friedman et al. | |
| 7,584,746 | B1 | * | 9/2009 | Furchill et al. | 123/456 |

FOREIGN PATENT DOCUMENTS

| | | |
|---|---|---|
| FR | 2 861 058 A1 | 4/2005 |
| FR | 2 862 614 A1 | 5/2005 |
| GB | 2 275 891 A | 9/1994 |

* cited by examiner

PACKAGING ASSEMBLY

CROSS REFERENCE TO RELATED APPLICATIONS

This application is a National Stage of International Application No. PCT/FR2010/050231 filed Feb. 11, 2010, claiming priority based on French Patent Application No. 09 50961, filed Feb. 16, 2009, the contents of all of which are incorporated herein by reference in their entirety.

The present invention relates to a packaging assembly comprising a card on which a fluid dispenser is mounted. The preferred field of application of the present invention is the field of fragrance or cosmetic samples packaged in a reservoir provided with a dispenser member. However, the present invention may also apply to other fields in which it is necessary to fasten a fluid dispenser on a support that is preferably flat.

In the field of fragrance samples, it is has been known for a long time to associate a small perfume bottle with a card constituted by one, two, or three panels that are hingable relative to one another. A conventional configuration is that of a card comprising two panels that are interconnected via an edge section, the two panels extending substantially parallel to each other together like a book jacket. The small perfume bottle, generally constituted by a reservoir closed by a stopper, is disposed between the two panels, in manner that is adjacent to the edge section. A known configuration of the prior art makes provision for fastening the small bottle to the edge section by means of one or two loops that are formed by cuts in the card. Thus, the packaging assembly is merely constituted by two component elements, namely the small bottle and the card, given that the means that make it possible to fasten the small bottle inside the card form an integral part of the card. That type of packaging assembly, which has been very widespread for very many years, does however present a few drawbacks. A first drawback resides in the fact that the configuration of the card (folded in half) cannot be modified or modulated very much as a result of it being necessary to arrange the small bottle inside the card. In view of the thickness of the small bottle, it is essential to make the card with an edge section of thickness that is sufficient to enable the two panels of the card to extend in substantially parallel manner on either side of the small bottle. Another drawback resides in the fact that the small bottle is not visible, at least not directly visible, given that it is inserted, and as a result hidden, inside the card. A third drawback resides in the fact that generally the two panels of the card are not connected together at their free side edges, such that the two panels of the card may move freely: there is not really a predetermined open or closed position. Finally, another problem results from the fact that the card presents a certain amount of thickness, which does not facilitate packaging it in large numbers.

Document DE 88 00 244 describes a card comprising two panels that are hinged on a common edge. One panel includes a connection element that serves to receive a pen. The connection element is fastened on the panel of the card by adhesive bonding which is not very good since it requires an adhesive-spreading operation that is always difficult to control, and an adhesive bonding operation at a precise location on the panel. The present invention seeks to avoid using adhesive for fastening the connection element on the panel of the card.

In the prior art, document FR-2 732 875 is also known, which describes a sample presentation device comprising a card provided with a window, and a lipstick provided with a rib in the shape of a dovetail that is engaged in the window. It is not possible to pass the lipstick through the window, only the rib being engaged by sliding in the window via a wide end. It can easily be understood that the insertion of the rib in the window is a complicated operation that cannot be automated. The present invention also seeks to simplify assembling the connection element on the card.

To solve these problems, the present invention proposes a packaging assembly comprising: a card comprising at least one panel; a fluid dispenser comprising a fluid reservoir and a fluid dispenser member that is mounted on the reservoir; a connection element fitted on the panel of the card, the connection element including fastener means, the dispenser being engaged in the fastener means for being held in removable manner on the card; wherein the panel includes a window, the connection element being fitted in the window, the connection element includes a base, advantageously a flat base, of dimension that is greater than the dimension of the window, the fastener means projecting from the base, the base being disposed on one side of the panel with the fastener means passing through the window in such a manner as to project from the other side of the panel, the packaging assembly being characterized in that the fastener means are inserted through the window and present a dimension that is slightly greater than the dimension of the window, thereby holding the connection element in the window, even in the absence of a dispenser. Thus, in contrast to the above-mentioned prior-art packaging assembly, the connection element is not adhesively-bonded on the card, it does not form an integral part of the card, and it does not form an integral part of the dispenser. The connection element constitutes a third component element of the packaging assembly, which connection element is firstly fitted through the window in the card, and secondly fastened to the dispenser, such that the element forms the connection between the card and the dispenser. The connection element thus passes through the window, but cannot pass completely through the window, given that the base of the connection element presents dimensions that prevent it from passing through the window. The base thus serves as a retaining member enabling the fastener means to pass through the window and to extend from the other side of the panel, the fastener means nevertheless being secured to the panel as a result of the base not being able to pass through the window. In an additional advantageous characteristic, the fastener means may present a dimension that is slightly greater than the dimension of the window, so as to hold the connection element in the window, even in the absence of a dispenser. While putting the connection element into place on the panel, it suffices to force the connection element a little, so as to cause the fastener means to pass through the window, preferably with a certain degree of elasticity. Then, the connection element is held captive in the window, given that the base cannot pass through the window, and given that the fastener means cannot move freely out from the window. This configuration makes it possible to connect the connection element to the card, in such a manner as to constitute a subassembly that cannot become separated. Provision may even be made for the connection element to be snap-fastened inside the window.

In another advantageous aspect of the invention, the fastener means may form a housing in which the dispenser is received in removable manner. Preferably, the housing is elastically deformable and includes a side access passage. The housing makes it possible not only to remove the dispenser when the packaging assembly is used for the first time, but also makes it possible subsequently to put the dispenser back into the housing. In other words, the housing is not destroyed when the dispenser is removed for the first time: on the contrary, the dispenser may be removed and put back into place in the housing several times. The side access passage makes it possible to remove the dispenser very easily from its housing and to put it back into place very easily, without having to slide it via one end, as in the prior art with the cards forming one or two loops through which the small bottle must be slid. As a result of the housing being resilient, the side access passage opens while the dispenser is being removed from the housing and while it is being put back into place, and returns to its initial rest position once the dispenser is in place or is completely removed.

In an advantageous embodiment, the card comprises at least two panels that are hinged relative to each other in such a manner as to be capable of being superposed at least in part, namely a first panel forming the window, and a second panel defining a free side edge that extends under the dispenser when the two panels are superposed, in such a manner as to hold them in the superposed position. Advantageously, the second panel forms a cutout through which the fastener means of the connection element pass when the two panels are superposed. Preferably, the cutout is formed at the free side edge of the second panel, such that said cutout is open, the second panel nevertheless being hingable relative to the first panel without removing the dispenser from the fastener means. Thus, the connection element, alone or in co-operation with the dispenser, makes it possible to hold the two panels superposed. The connection element thus performs a closing function for the card. However, it is possible to cause the second panel to pivot relative to the first by disengaging said second panel from the connection element and/or from the dispenser. In this configuration, the card need comprise only two panels that are interconnected via a common edge forming the hinge. In an alternative embodiment, in the superposed position, the panel comprises two connected-together sheets, the base of the connection element being disposed between the two sheets.

However, in a preferred embodiment, the card may include a third panel that is disposed between the first and second panels, such that the first and second panels are hinged on the third panel in such a manner as to be capable of superposing the three panels at least in part. Thus, the card is in the form of a triptych, the third panel constituting the central panel, on the vertical side edges of which there are hinged the first and second panels, provided with the window and with the cutout respectively. The connection element, alone or in combination with the dispenser, makes it possible to hold the triptych closed, with the three panels superposed. Advantageously, the base is disposed between the first and third panels. It is also possible to adhesively bond the first and third panels together permanently in the superposed position, pinching between them the base of the connection element that is thus completely and permanently invisible.

In a practical embodiment, the connection element is a part that is made by injection-molding a plastics material, the element comprising a disk-shaped flat base from which there extend two resilient arms that curve towards each other, forming between them a housing for fastening the dispenser.

Advantageously, the fastener means include two arms having a maximum distance apart that is slightly greater than the width of the window, such that the arms may be inserted through the window by being forced a little. Thus, the connection element is held inside the window by its own arms.

Advantageously, the fastener means include snap-fastener profiles that co-operate with edges of the window so as to fasten the connection element in stable manner inside the window.

Advantageously, the dispenser includes an annular groove, the fastener means being received in the groove, filling it at least in part.

An advantageous principle of the present invention resides in using a separate connection element for fastening a dispenser on a card by passing the fastener means of the connection element through a window of the card when there are a plurality of panels, the connection element advantageously serving as a clasp making it possible to hold the panels in the superposed position.

The invention is described more fully below with reference to the accompanying drawings, which show an embodiment of the invention by way of non-limiting example.

Figure 2:
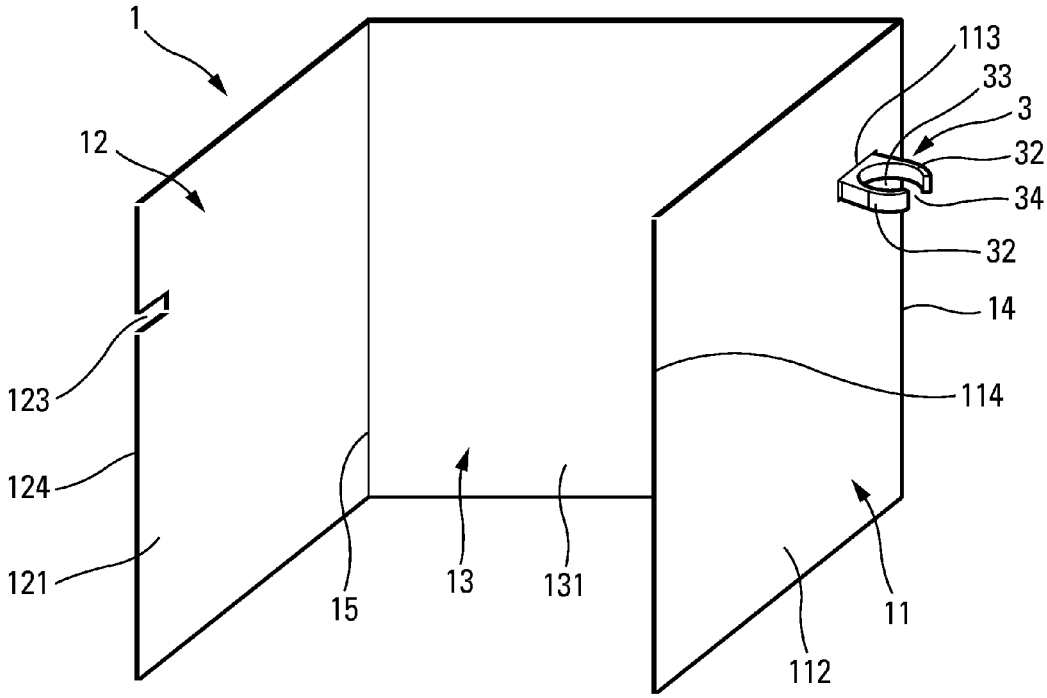
Figure 3:
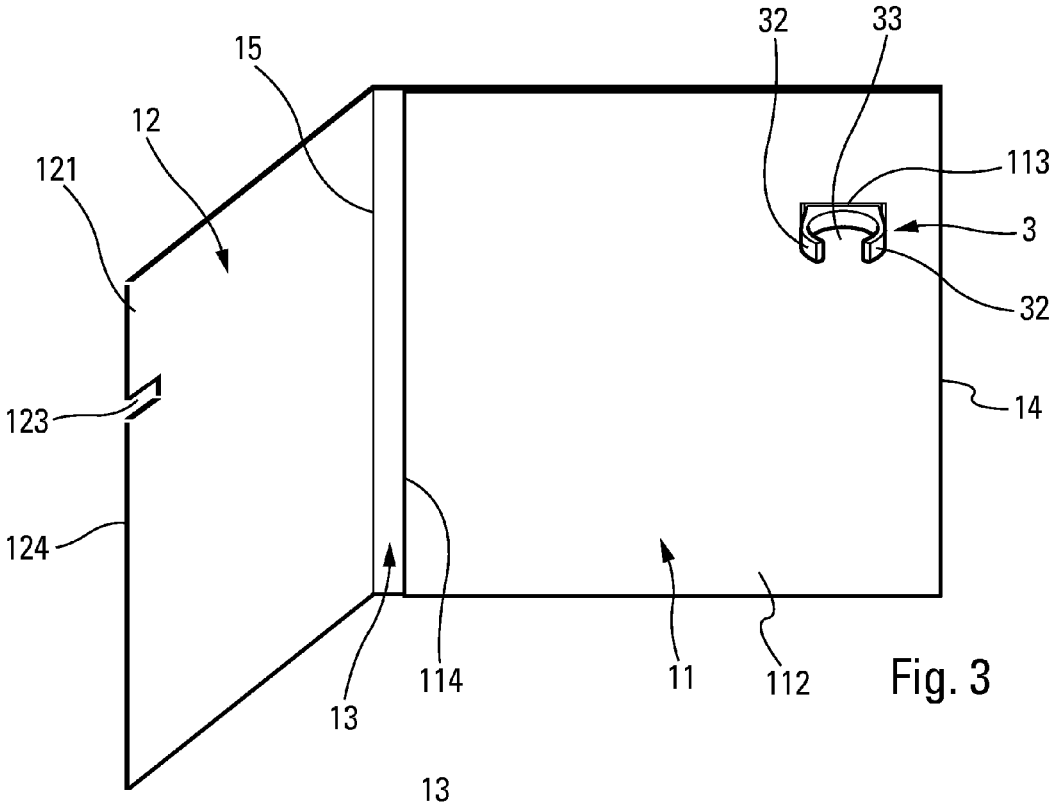
Figure 4:
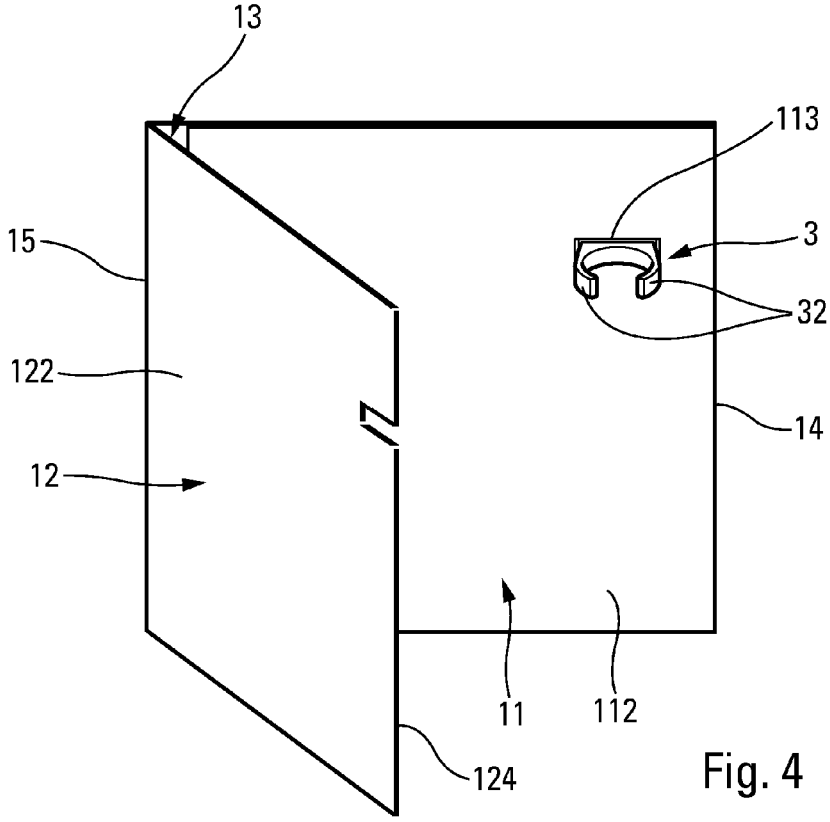
Figure 5:
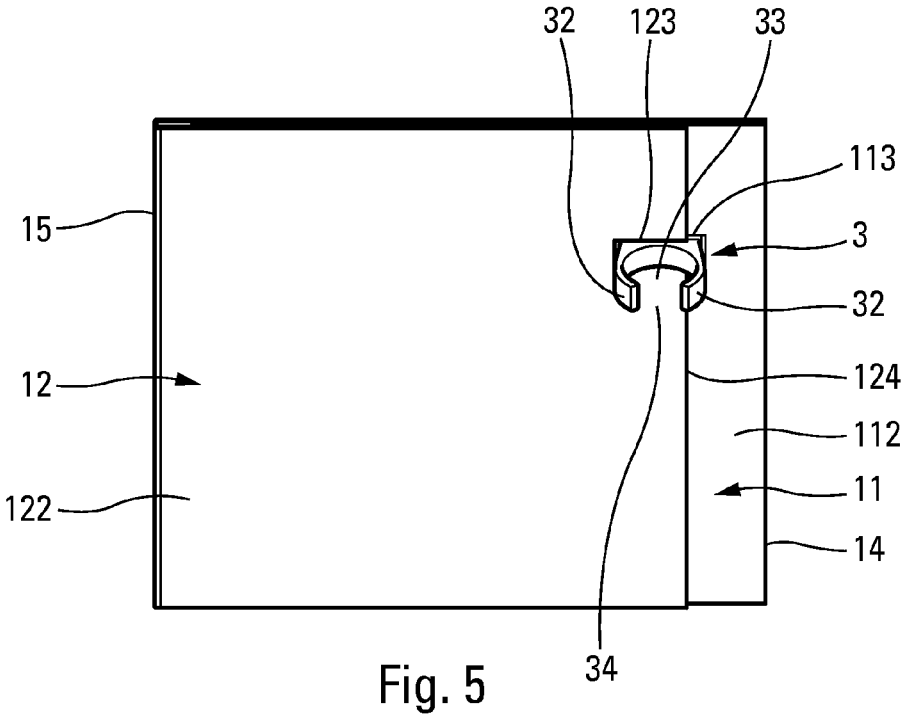
Figure 6:
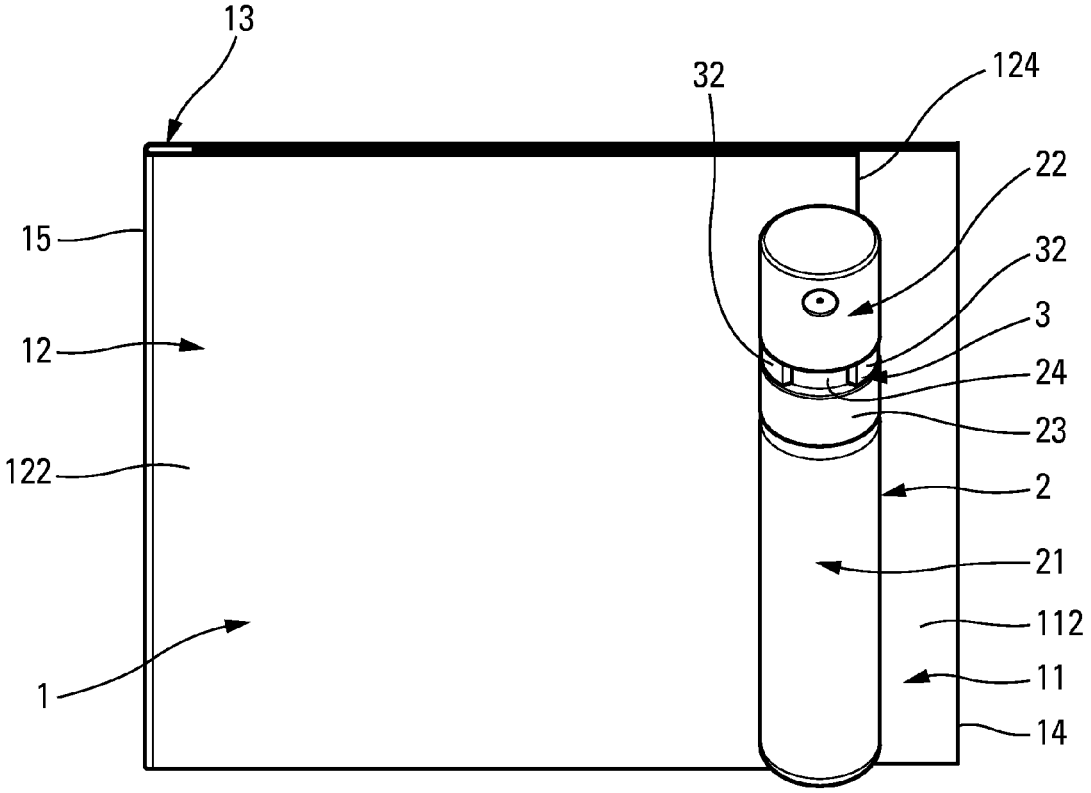

In the figures:

FIG. 1 shows a three-panel card of the invention provided with a connection element, the card being in its unfolded state;

FIGS. 2, 3, and 4 show the FIG. 1 card during various stages of folding;

FIG. 5 shows the card of the above figures in its completely folded state, with all of the panels superposed; and FIG. 6 is a view of the packaging assembly of the invention with its dispenser, the packaging being in its folded state.

Reference is made initially and briefly to FIG. 6 that shows a card 1 of substantially rectangular shape in its folded or closed state, and a fluid dispenser 2 that is disposed and fastened on the card 1. As described below, the card 1 comprises three superposed panels that are not easily visible in FIG. 6 given that they are superposed. However, it is possible to observe a first panel 11 with a second panel 12 extending over a large fraction thereof. The card 1 also includes a third panel 13 that extends behind the first panel 11. The first panel 11 is hinged relative to the third panel 13 along a common edge 14 that acts as a hinge. In symmetrical manner, the second panel 12 is connected to the third panel 13 via a common edge 15 that acts as a hinge. Thus, the first and second panels 11, 12 are connected and hinged together by means of the third panel 13. The card 1 is described in greater detail with reference to FIGS. 1 to 4.

In this embodiment, the dispenser 2 is disposed, in part, on the first panel 11 and, in part, on the second panel 12. It can also be said that the dispenser 2 extends over the second panel 12 that extends over the first panel 11 that extends over the third panel 13. The dispenser 2 includes a reservoir 21 for containing a fluid, such as a fragrance. The reservoir includes a bottom wall at one of its ends and an opening at its other end. The dispenser 2 includes a dispenser member 22 that is mounted on the opening of the reservoir 21. In order to fasten the dispenser member 22 on the reservoir 21, a fastener ring 23 is provided in which the dispenser member 22 is received, and which includes fastener means for fastening on the reservoir 21. Between the dispenser member 22 and the fastener ring 23, the dispenser forms an annular groove 24 in its rest state. When the dispenser member 22 is actuated, the groove disappears or narrows: the dispenser member 22 thus moving towards the fastener ring 23. This design is entirely conventional for a fluid dispenser of the sample type in the field of perfumery or even cosmetics. Mainly for appearance purposes, the dispenser 2 presents a configuration that is substantially cylindrical, and advantageously circular. In this embodiment, the dispenser member 22 is a pump, but the pump 22 may very well be replaced by a mere stopper or even an extractor or an applicator endpiece.

The dispenser 2 is held in place on the card 1 by means of a connection element 3 that is barely visible in FIG. 6. All that can be seen are two resilient arms 32 that serve as removable fastener means: the arms 32 being housed in the groove 24 of the dispenser 2. The connection element 3 is described in greater detail below.

The card 1, the dispenser 2, and the connection element 3 form a complex packaging assembly that may find an advantageous application in the field of fragrance or cosmetic samples. The dispenser performs a known function of storing and dispensing fluid, while the card 1 performs a technical function of supporting the dispenser, and also a function of presenting information relating to the origin and to the nature of the dispenser. Naturally, the card 1 also performs a major function concerning the appearance of the packaging assembly. The card 1 may support any form of indication, such as text, a logo, an image, colors, etc. The card 1 may be completely flat, or may even form portions in relief, cutouts, openings, slots, etc. making it possible to impart an attractive appearance to the card.

It is immediately apparent that the dispenser 2 is not inserted inside the card 1, but, on the contrary, is disposed on the card 1 in such a manner that it is completely visible from various angles. The card 1 presents a superposed configuration that is very compact, the three panels 11, 12, and 13 being superposed in contact with one another. The combined thickness of the card 1 in its folded state, as shown in FIG. 6, is of millimeter order.

The card 1 that has been used to illustrate this particular embodiment of the present invention comprises three panels 11, 12, and 13, as described above. However, without going beyond the ambit of the invention, the card 1 may comprise only two panels, or even a single panel. From FIG. 6, it is entirely possible to imagine that the first panel 11 is connected directly to the second panel 12 via a common hinge edge. It is also possible to imagine that the card 1 is constituted by a single panel only, formed by the three panels that are adhesively bonded together.

Reference is made below to FIGS. 1 to 5 in order to describe in detail the structure and the linkage of the card 1 associated with its connection element 3, the dispenser 2 being omitted for the purpose of clarity and of simplification of the figures.

In FIG. 1, it can be seen that the card 1 comprises three substantially-rectangular flat panels 11, 12, and 13 that are connected together as a single part. The first panel 11 is connected to the third panel 13 via a common hinge edge 14, while the second panel 12 is connected to the third panel 13 via another common hinge edge 15, as presented above. The third panel 13 thus constitutes the intermediate central panel to which the two side panels 11 and 12 are hinged in the manner of a triptych. Thus, the first panel 11 includes a free vertical side edge 114, and the second panel 12 also includes a free vertical side edge 124. The panel 11 includes an inner face 111 and an outer face 112. Similarly, the second panel 12 includes an inner face 121 and an outer face 122. The intermediate third panel 13 also includes an inner face 131 and an outer face (not referenced since it is not visible in the figures). From FIG. 1, it can easily be understood that the first panel 11 may pivot relative to the third panel 13 about an axis that is constituted by the common hinge edge 14. Similarly, the second panel 12 may pivot about an axis that is constituted by the common hinge edge 15. Thus, the panels 11 and 12 may be folded onto the central panel 13, or, on the contrary, may be unfolded so as to arrange the three panels 11, 12, and 13 in a single common plane, for example. All of the faces of the panels, or only some, may be provided with indications of various kinds. The inner faces 111, 121, and 131 may include text, for example, while the inner faces 112, and especially 122, may serve to support more attractive creations.

It can be seen that the second panel 12 includes a cutout 123 in the form of an elongate notch that opens out onto the free vertical side edge 124. This is a particular non-limiting embodiment: a similar cutout may be formed at some other location of the panel 12, in particular at a distance from its edges. However, the cutout 123 opening out onto the free edge 124 constitutes a preferred embodiment, having advantages that are described below.

In addition, the first panel 11 includes a window 113 that is not visible in FIG. 1, but that is completely visible in FIGS. 2 to 5. In this particular embodiment, the window 113 presents an elongate rectangular shape that is similar to a slot. In this embodiment, the window 113 is disposed in the proximity of the common hinge edge 14, and in the top portion of the panel 11. In reality, the window 113 and the cutout 123 are disposed relative to each other in such a manner that they come into alignment with each other when the two panels 11 and 12 are folded onto the panel 13, as in FIGS. 5 and 6. Thus, it is understood that the positions of the cutout 123 and of the window 113 are directly connected to each other. The window 113 could be disposed in the proximity of the free edge 114: under such circumstances, the cutout 123 would be positioned in the proximity of the common hinge edge 15.

As mentioned above, the packaging assembly includes a connection element 3 that is in the form of a part that is separate both from the card 1 and from the dispenser 2. By way of example, the connection element 3 may be made by injection molding an appropriate plastics material. The connection piece 3 is preferably made as a single part. It comprises a base 31 from which there project fastener means 32 that, by way of example, may be in the form of two curved arms that extend towards each other, without however joining, thereby defining between them a side access passage 34. The arms 32 define between them a housing 33 that serves to receive the dispenser 2. More precisely, the arms 32 clamp the dispenser 2 at the groove 24 formed between the dispenser member 22 and the fastener ring 23. The curved arms 32 are resilient, thereby making it possible to insert and to remove the dispenser from the housing 33 by elastically spacing the arms 32 apart, thereby causing the dimension of the side access passage 34 to vary. The particular embodiment constituted by two curved arms 32 should not be considered as limiting: it is possible to imagine fastener means that use some other technique, and as a result present some other structural shape. The curved arms 32 use a traditional reversible snap-fastening technique, enabling the dispenser 2 to be fastened in removable manner. It is possible not only to remove the dispenser 2 from the housing 33, but also to re-insert it therein, without deteriorating the tabs 32. In this embodiment, the base 31 is in the form of a substantially-flat round disk. However, it is possible to imagine other shapes for the base 31.

The connection element 3, constituted by its base 31 and by its fastener means 32, is fitted on the card 1, in the window 113 of the first panel 11. The arms 32 are inserted through the window 13 from the inner face 111, such that they finally project from the outer face 112, as can be seen in FIG. 2. The connection element 3 may thus be inserted through the window 113 until its base 31 comes into contact with the inner face 111, as can be seen in FIG. 1. The final assembled position is thus achieved in which the curved arms 32 project as far as possible from the plane defined by the outer face 112 of the panel 11. This is shown in FIG. 2. It should be observed that the housing 33 is disposed entirely on the outer face 112, with only the root of the arms 32 being disposed in the plane of the window 113. According to an advantageous optional characteristic, the maximum distance between the two arms 32 is slightly greater than the width of the window 113, such that the arms 32 may be inserted through the window 113 by being forced a little. This ensures that the connection element 3 is held inside the window 113, thereby ensuring that the sub-assembly of the card 1 and of the connection element 3 cannot become separated. Naturally, the base 31 should present dimensions such that it is impossible to pass it through the window 113. In very simple manner, the base 31, constituted in this embodiment by a round disk, presents a diameter that is greater than the maximum dimension of the window 113, specifically its width. It is also possible to imagine other techniques or systems that make it possible to secure the connection element 3 on the panel 11. It is possible to imagine that the arms 32 present snap-fastener profiles, preferably irreversible profiles, that, by way of example, co-operate with the edges of the window 113 so as to fasten the connection element 3 inside the window 113 in stable and advantageously permanent manner. To do this, two small grooves could be provided at the base of the arms 32, making it possible to receive two opposite edges of the window 113.

Once the connection element 3 is in place in this way in the window 113 of the first panel 11, it is possible to begin to fold the panels 11 and 12 onto the central panel 13, as can be seen in FIG. 2. The panel 11 is folded first, while the panel 12 remains momentarily stationary. This operation continues until the panel 11 comes into contact with the panel 13, as shown in FIG. 3. In this position, the base 31 is no longer visible, since it is disposed between the panel 11 and the panel 13. It is thus particularly advantageous to make the base 31 very thin, so as not to prevent the two panels 11 and 13 from being superposed. The panel 12 may then the folded onto the panel 11, as can be seen in FIG. 4. In the end, shown in FIG. 5, the panel 12 is superposed on the panel 11, with the cutout 123 receiving the arms 32 of the connection element 3. It can also be said that the cutout 123 takes up a position on the window 113. It should thus be observed that the free edge 124 of the panel 12 does not extend as far as the common hinge edge 14. On the contrary, the free edge 124 extends over the window 113 in such a manner that the arm 32 are situated outside the cutout 123. Thus, the dispenser 2 may be fitted on the card 1 and fastened in the housing 33 between the arms 32 by passing through the side access passage 34. The dispenser 2 comes to cover the free edge 124 of the second panel 12, as can be seen in FIG. 6. However, given that the cutout 123 is open on the edge 124, it is still possible to remove the panel 12 from under the dispenser 2 by sliding its edge 124 from under the dispenser 2, curving the panel 12 a little. Nevertheless, this requires voluntary manipulation by the user. In other words, the panel 12 cannot become disengaged from under the dispenser 2 in involuntary or accidental manner. The dispenser 2 thus performs a function of closing or blocking the card 1 in its closed state, blocking the panel 12 under the dispenser 2. When the dispenser 2 is removed from the housing 33, the configuration is thus as shown in FIG. 5, and the panel 12 may pivot freely, moving away from the panel 11. In a variant, it is possible to provide small notches in the portions of the arms 32 that are in the cutout 123, thereby making it possible to hold, by snap-fastening, the panel 12 in the configuration shown in FIG. 5. The connection element 3 thus also performs a function of closing, blocking, or holding the panel 12 in its closed state.

The closing or holding function performed by the connection element 3, alone or in combination with the dispenser 2, may also be implemented on a card 1 comprising only two panels that are hinged relative to each other about a common hinge edge. Similarly to the embodiment shown in the figures, this could occur by eliminating the panel 13, and by connecting the panel 11 directly to the panel 12.

It is also possible to make a card having two hingable panels from the card having three panels 11, 12, and 13, by adhesively bonding or heat sealing the panel 11 on the panel 13. It should thus be observed that the base 31 of the connection element is held captive permanently, since it is trapped between the two panels that thus now form only a single panel.

The card 1 could possibly comprise only a single panel, e.g. the panel 11, but, in this configuration, the closing or holding function is no longer implemented. It is quite possible to imagine that the dispenser 2 is fitted directly on the panel 11.

Isolated protection could be desired for the connection element under consideration, i.e. independently of the card.

The connection element 3 is fastened to the card by passing through the window 113. However, it is possible to envisage fastening the base of the connection element directly on the panel 11, e.g. by adhesive or by heat-sealing.

By means of the invention, it is easy to fasten a dispenser on a simple card, or even to fasten a dispenser on a hinged-panel card while further performing a function of closing or holding the card in its closed position.

The invention claimed is:

1. A packaging assembly comprising:

a card comprising at least one panel;

a perfume or cosmetics sample dispenser comprising a fluid reservoir and a fluid dispenser member mounted on the reservoir, the sample dispenser including an annular groove configured to narrow in width when the dispenser member is actuated;

a connection element fitted on the panel of the card, the connection element including fastener means, the sample dispenser engaged in the fastener means in a removable manner on the card, the fastener means to be received in the annular groove;

wherein the panel includes an elongated rectangular window having a maximum width between opposite edges of the window, the connection element configured to fit in the window, wherein the connection element includes a circular base, and a diameter of the base is larger than the maximum width of the window which prevents the base from passing through the window, the fastener means configured to project from the base, the base being disposed on one side of the panel with the fastener means disposed in the window so as to project from the other side of the panel;

wherein a width of the fastener means is slightly greater than the maximum width of the opposite edges of the window, so that the fastener means is configured to be force fit through the width of the window so as to be disposed in abutment with the opposite edges of the window, thereby holding the connection element in the window in a stable manner, even in the absence of the sample dispenser.

2. A packaging assembly according to claim 1, wherein the fastener means include two arms having a maximum distance apart that is slightly greater than the width of the window, such that the arms are configured to be forced inward to be inserted through the window.

3. A packaging assembly according to claim 1, wherein the fastener means include snap-fastener profiles that co-operate with edges of the window so as to fasten the connection element in stable manner inside the window.

4. A packaging assembly according to claim 1, wherein the fastener means form a housing in which the dispenser is received in removable manner.

5. A packaging assembly according to claim 4, wherein the housing is elastically deformable and includes a side access passage.

6. A packaging assembly according to claim 1, wherein the card comprises at least two panels that are hinged relative to each other in such a manner as to be capable of being superposed at least in part, namely a first panel forming the window, and a second panel defining a free side edge that extends under the dispenser when the two panels are superposed, in such a manner as to hold them in the superposed position.

7. A packaging assembly according to claim 6, wherein the second panel forms a cutout through which the fastener means of the connection element pass when the two panels are superposed.

8. A packaging assembly according to claim 7, wherein the cutout is formed at the free side edge of the second panel, such that said cutout is open.

9. A packaging assembly according to claim 6, wherein the card includes a third panel that is disposed between the first and second panels, such that the first and second panels are hinged on the third panel in such a manner as to be capable of superposing the three panels at least in part.

10. A packaging assembly according to claim 9, wherein the three panels are blocked in the superposed position by the dispenser that is held on the card by the connection element.

11. A packaging assembly according to claim 10, wherein the base is disposed between the first and third panels.

12. A packaging assembly according to claim 1, wherein the panel includes two sheets that are connected together in the superposed position, the base of the connection element being disposed between the two sheets.

13. A packaging assembly according to claim 1, wherein the connection element is a part that is made by injection-molding a plastics material, the connection element comprising a flat base from which there extend two resilient arms that curve towards each other, forming between them a housing for fastening the dispenser.

14. A packaging assembly comprising:

a card comprising at least one panel;

a perfume or cosmetics sample dispenser comprising a fluid reservoir and a fluid dispenser member mounted on the reservoir, the sample dispenser including an annular groove configured to narrow in width when the dispenser member is actuated;

a connection element fitted on the panel of the card, the connection element including fastener means, the sample dispenser engaged in the fastener means in a removable manner on the card, the fastener means to be received in the annular groove;

wherein the panel includes an elongated rectangular window having a maximum width between opposite edges of the window, the connection element configured to fit in the window, wherein the connection element includes a base, and any dimension of the base is greater than the maximum width of the window which prevents the base from passing through the window, the fastener means configured to project from the base, the base being disposed on one side of the panel with the fastener means disposed in the window so as to project from the other side of the panel;

wherein a width of the fastener means is slightly greater than the maximum width of the opposite edges of the window, so that the fastener means is configured to be force fit through the width of the window so as to be disposed in abutment with the opposite edges of the window, thereby holding the connection element in the window in a stable manner, even in the absence of the sample dispenser.

* * * * *